United States Patent [19]

Hannan et al.

[11] Patent Number: 5,050,739

[45] Date of Patent: Sep. 24, 1991

[54] DISPOSABLE FOLDABLE MEDICATION CARD

[75] Inventors: Paul J. Hannan, Newport; Gerard T. Stevens, Abbotsford, both of Australia

[73] Assignee: Manrex Australia Pty. Ltd., Abbotsford, Australia

[21] Appl. No.: 652,448

[22] Filed: Feb. 7, 1991

Related U.S. Application Data

[63] Continuation of Ser. No. 432,563, Nov. 6, 1989, abandoned.

[30] Foreign Application Priority Data

Nov. 11, 1988 [AU] Australia ..... PJ1392

[51] Int. Cl.[5] ..... B65D 83/04; B65D 75/36; B65D 21/02

[52] U.S. Cl. ..... 206/531; 206/534

[58] Field of Search ..... 206/531, 534

[56] References Cited

U.S. PATENT DOCUMENTS

| | | | |
|---|---|---|---|
| 3,921,804 | 11/1975 | Tester | 206/531 |
| 4,340,141 | 7/1982 | Fischer | 206/531 |
| 4,473,156 | 9/1984 | Martin | 206/534 |
| 4,664,262 | 5/1987 | White | 206/531 |
| 4,838,425 | 6/1989 | O'Brien et al. | 206/531 |
| 4,887,790 | 12/1989 | Wilkinson et al. | 206/531 |
| 4,911,304 | 3/1990 | Bunin | 206/531 |

FOREIGN PATENT DOCUMENTS

| | | | |
|---|---|---|---|
| 859539 | 12/1970 | Canada | 206/534 |
| 2929185 | 2/1981 | Fed. Rep. of Germany | 206/531 |
| 537319 | 7/1973 | Switzerland | 206/531 |

*Primary Examiner*—William I. Price

*Attorney, Agent, or Firm*—Dellett, Smith-Hill and Bedell

[57] ABSTRACT

A disposable medication package comprises a card (1) printed on one side and divided by fold lines (7,8,9 and 10) into panels (2,3,4,5, and 6). The panels (2 and 3) have windows (13, 15) which register with one another when the panel (2) is folded behind the panel 3. Likewise, the panels (5 and 6) have windows which register with one another when the panel (6) is folded behind the panel (5). The card has its unprinted side coated with a heat-sealable material. The two panels (2 and 6) have metal foils tacked to them and are provided on their surface with heat-sealable material. The package is made up by placing the card, printed side downwards, on a platen. Blister sheets (16, 21) are placed on the panels (3 and 5) so that their blisters protrude through the windows (13 and 15). Medication tablets are loaded into the blister cavities and the two panels (2 and 6) are then folded over the tops of the cavities so that the foils and blister sheets are sandwiched between the overlapping panels (2, 3 and 5,6). A hot platen is then pressed down on the assembly so that the heat-sealable materials fuses and adheres together the blister sheets, foils and panels. The package is then folded along the lines (8 and 9) to bring the blisters one panel (3) between the blisters of the other panel (5). A holder may be used to retain the package in its folded condition and to protect the rectangular zones of the foils exposed in the windows.

11 Claims, 3 Drawing Sheets

DISPOSABLE FOLDABLE MEDICATION CARD

This is a continuation of application Ser. No. 07/432,563 filed Nov. 6, 1989 and now abandoned.

FIELD OF THE INVENTION

THIS INVENTION relates to the administration of oral, solid dose medication, and is more specifically concerned with the design of a cheaply-constructed medication package capable of being assembled by a pharmacist and loaded in accordance with a doctor's prescription, the package ensuring that a patient receives his prescribed medication at the correct intervals of time.

STATE OF THE ART

Oral, solid dose medication in the form of tablets and capsules are commonly prescribed in bottles and blister packs. A label typed up by a pharmacist tells the patient how many tablets he should take and how often. Older patients often have poor memories and cannot always recall whether they have taken their medication at a particular time, or the number of possibly different tablets they should take at a particular time. They then either respond by taking, unnecessarily in many cases, a further dosage in the belief that they have missed one, or, fail to take a dosage at all in the mistaken belief that they already have.

Manufacturers of pharmaceutical tablets have appreciated this problem and have responded by providing blister sheets containing individually removable tablets held in respective blisters. The blister sheets are sometimes clipped inside a foldable card on which information is printed as to when the tablets from the different packs are to be taken. Examples of blister sheets of various forms and some of which are associated with marking cards in a package, are to be found in U.S. Pat. Nos. 364,623 (Beidler); 3,324,995 (Sharp); 3,494,322 (Dubbles); 3,603,453, 3,659,706 and 3,737,029 (all being in the name of Serrell); 4,340,140 (Fischer); 3,621,992 (Osborne); and Canadian Patent No. 859,539 (Weir).

The advantage obtained by packaging tablets individually on a blister sheet is that the number of unused tablets can be seen at a glance by the patient. The tablets also remain in a hygienic state until required for use. Finally, as each blister sheet contains identical tablets, there is no risk of tablets of different types being confused with one another in the same blister sheet.

The above solution to the problem mentioned above makes no allowance for situations where elderly people are involved and require sometimes to take several tablets at different times. Many elderly people have short memories and are easily confused when confronted with a package containing a large number of blister sheets, some of which require the tablets to be taken at different intervals of time to others. For this and other reasons, it is the law in Australia for nursing homes for elderly people to have a qualified nursing sister responsible for administering medication to elderly people in the nursing home. This naturally increases the costs of running a nursing home for elderly people, and involves some loss of independence on their part.

To help cope with this problem, U.S. Pat. No. 3,759,371 (Mark) proposes providing a package formed from two shaped sheets which are locked together and define between them an array of independently openable pockets each of which may contain one or more tablets. One of these sheets is made from a depressible transparent material and the other sheet provides a zone weakened by perforations behind each of the pockets. The patient uses the package by depressing the transparent sheet overlying one of the pockets so that the tablets within it are ejected through the weakened zone of the other sheet.

The advantage of the Mark's proposal mentioned above, is that the package can be loaded in a hospital in accordance with a doctor's prescription, so as to provide in its pockets the total medication periodically required by a particular patient. The patient's name is identified on the package and the responsibility of filling the package with the correct medication is accepted by the hospital. All the patient is required to do is to take the contents of each particular pocket at a particular time. Unfortunately, as mentioned above, elderly patients often have short memories and the Mark's package does not tell the patient, from looking at the package, whether or not he has taken his medication at a particular time. As a result, he may take more than one dose of the medication at a particular time, or, fail to take his medication at all.

OBJECT OF THE INVENTION

An object of this invention is to provide a simply-constructed and disposable medication package which is capable of being easily loaded with tablets by a pharmacist in accordance with a doctor's prescription and of being then used by a patient in a way which allows him to see whether or not he has taken the medication prescribed for him at a particular time.

THE INVENTION

In accordance with a first aspect of this invention there is provided an assembly for enabling a pharmacist to make up a medication package, the assembly comprising a card provided with fold lines dividing it into two separated pairs of panels having matched windows which, in one pair of panels, are staggered with respect to the windows of the other pair of panels; one face of the card being printed and the other face being coated with a heat-sealable material; two, easily-ruptured foils attached respectively to the unprinted faces of a respective one of each of the two pairs of panels and covering their windows; heat-sealable material coating the exposed surfaces of the foils on their sides remote from the windows; and two transparent and manually-depressible blister sheets each formed with blisters arranged to protrude through respective windows of the unfoiled panels when the sheets are placed against them.

To assemble the package of the first aspect of the invention, the pharmacist places a card with its printed face downwards, onto a platen shaped to accommodate the blisters. The two blister sheets are then placed on the exposed surfaces of the unfoiled panels so that their blisters protrude through their windows. Medication tablets, in accordance with a doctor's prescription, are placed into the cavities of the blisters. The two foiled panels are folded over the tops of the respective blister sheets so that the heat sealable coatings of the foils cover the backs of the blister sheets, and the windows of the two panels of each pair register with one another.

A heat-sealing platen is then pressed down onto the upper face of the layered assemblage described, to heat and fuse the heat sealable coatings so that a unitary assembly results. When the card is removed from between the platens, it is folded along two of the fold lines to bring the blistered faces of the panels opposite one another and the blisters of one panel between the blisters of the other panel. This provides a compact, robust medication package in which the tablets are sealed and from which the tablets cannot be removed except by the patient ejecting the tablets through the foil backing of the blisters.

The printing on the card references each blister to a particular time on a particular day. In this way an elderly person can see at a glance whether or not he has taken his prescribed medication by seeing whether there are still tablets in the corresponding blister.

In accordance with a second aspect of the invention, there is provided a medication-dispensing package for use by a patient, comprising a card having at least four panels separated by fold lines and foldable over one another, the panels being apertured to provide windows and two of the panels, which face one another in the folded card, having protruding through their windows transparent and manually-depressible blisters forming parts of two, separate, flat blister sheets respectively lying between each pair of folded-over panels, the windows of each pair of panels registering with one another and being staggered with respect to the windows of the other panel pair, so that, when the card is correctly folded, all the blisters interdigitate in substantially the same plane; rupturable foils covering the cavities of the blister sheets and being sealed with each blister sheet between a pair of panels; the card being printed in such a way that, when the card is opened, the blisters are displayed to the patient in intersecting sets of lines, and one set of lines is marked with the days of the week, and the other set of lines is marked on the card with the times of the day at which the medication contained in the blisters is to be taken.

PREFERRED FEATURES OF THE INVENTION

Preferably the card is disposable. Its construction requires, basically, only two components; the foiled card, which can be made from stiff paper; and two, identical blister sheets. The rows of blisters may be straight rows, or they may be kinked or curved as a result of the staggered formation of the blisters on the two pairs of panels.

A removable holder may be provided to hold the card in its folded condition between times of use, and may comprise a sleeve, a channel-shaped clip, or an elastic band.

An advantage of the invention is that a pharmacist can provide the patient with a folded disposable card which fits easily into the pocket or a handbag, and from which the patient can see at a glance whether he has taken his medication at the correct time. The card can store a week's supply of medication, and, at the end of the week, can be thrown away and a new one obtained from the pharmacist.

The blisters of the two sheets preferably are contiguous with one another when the card is folded, so that a compact relatively stiff package results. By using blisters of frusto-pyramidal shape with a rectangular base to the pyramid, the side walls of the blisters can be arranged to slide smoothly over one another during final folding movement of the card to the closed condition.

In the preferred arrangement of card for carrying out the invention, the card has parallel fold lines dividing it into four windowed card panels and has the outer two card panels folded over the backs of the inner two panels respectively. These latter two panels have the blisters protruding through their windows which face one another when the card is folded. The foil backing to the blisters are exposed through the windows of the outer two panels of the card lying on the outside of the folded-up package, and the printing on the card faces the patient when he opens the package.

In another arrangement for carrying out the invention the card is divided by parallel fold lines into four windowed panels. The outer two panels are similarly shaped, and are folded forwardly over the inner two panels. The blisters protrude through the windows of the outer two panels which lie inside the card when in its folded condition. The blisters are preferably again arranged to interfit to form a single layer in the folded card.

INTRODUCTION TO THE DRAWINGS

The invention will now be described in more detail, by way of examples, with reference to the accompanying and largely diagrammatic drawings, in which:

IN THE DRAWINGS

DESCRIPTION OF FIRST EMBODIMENT

Figure 1:
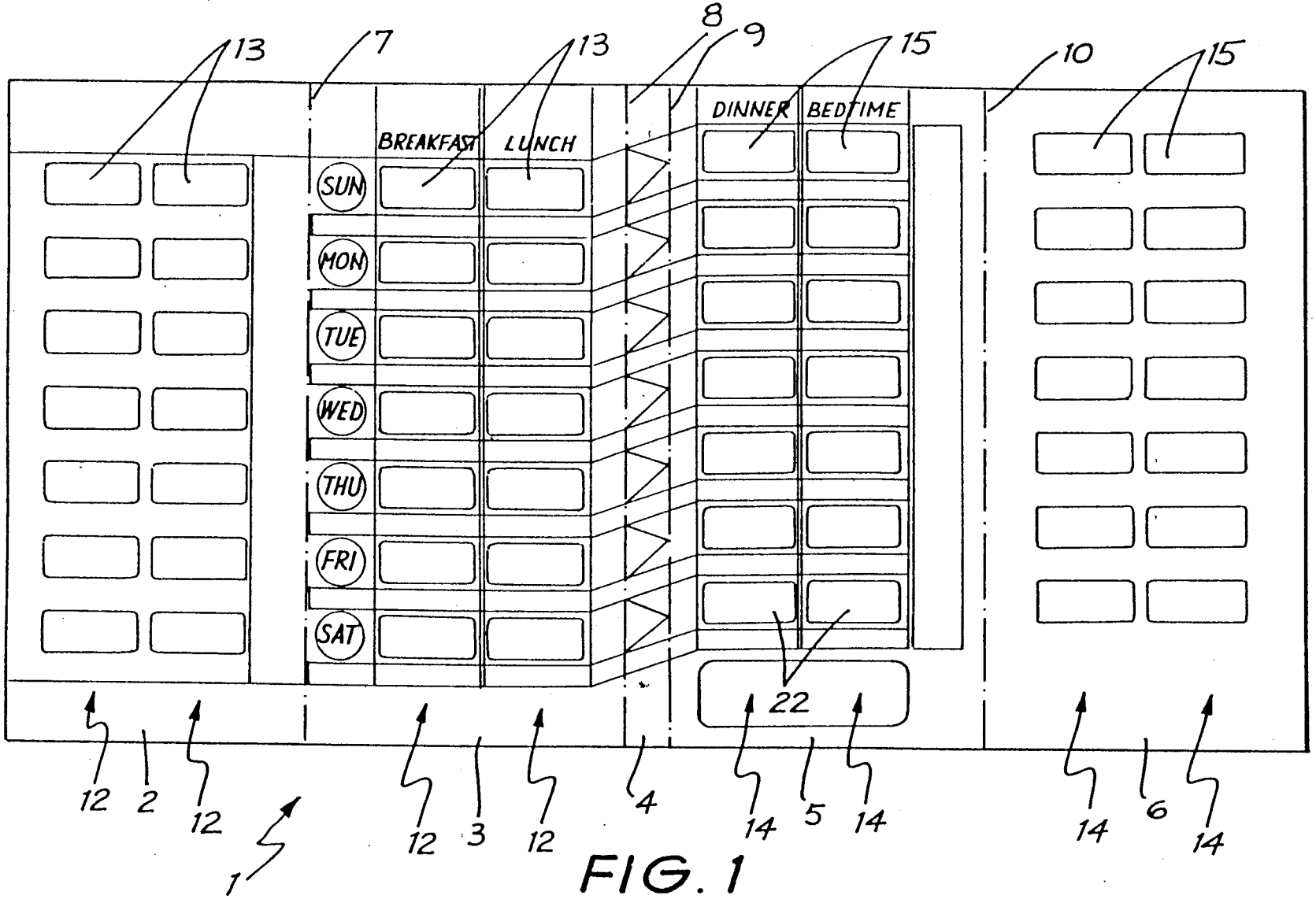
FIG. 1 is a front view of an unfolded card of a first embodiment.
Figure 3:
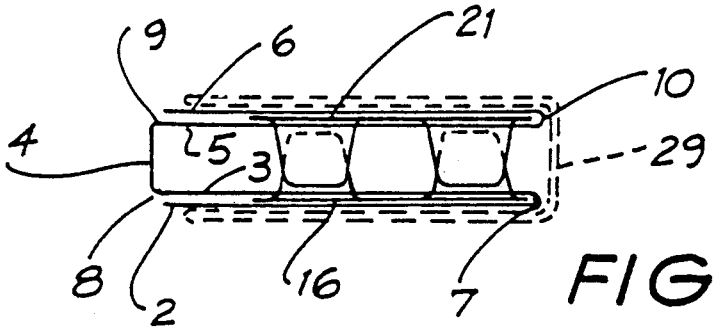
FIG. 3 is a plan view of the fully folded card of FIG. 2, shown with a holder in the form of a surrounding protective sheath illustrated in broken outline.

FIG. 1 shows a paperboard card 1 divided into five panels 2 to 6 by four parallel fold lines 7 to 10. The panels 2 and 3 are apertured to provide two columns 12 of rectangular windows 13 which register with one another when the panel 2 is folded backwards over the panel 3 as shown in FIG. 3.

The panels 5 and 6 are also apertured each to provide two columns 14 of rectangular windows 15 which register with one another when the panel 6 is folded backwards behind the panel 5. As shown, the horizontal center-lines of the windows 15 lie between and beneath the horizontal center-lines of the windows 13.

Figure 2:
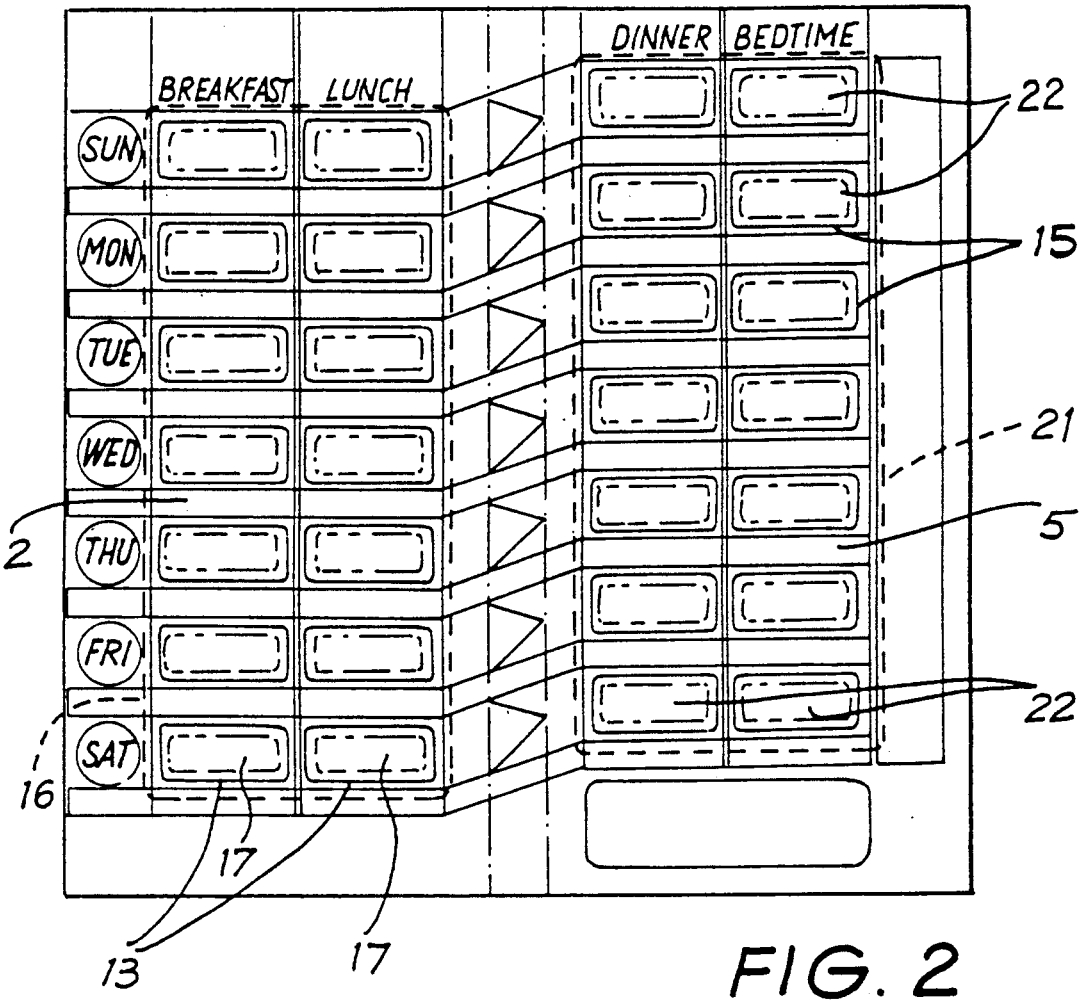
FIG. 2 is a front view of the card partially folded and containing two blister sheets.

FIG. 2 shows a blister packaging sheet 16 located between the folded-together panels 2 and 3 and a second blister packaging sheet 21 located between the folded-together panels 5 and 6.

The sheet 16 has fourteen, spaced, transparent and manually-depressible blisters 17 each of truncated pyramidal shape with a rectangular base to the pyramid. The blisters individually contain one or more tablets or capsules (not shown) of medication as prescribed by a doctor and inserted by a pharmacist into the blisters in accordance with a doctor's prescription. Each blister 17 protrudes through a respective one of the windows 13 of the panel 3. The blisters are formed by appropriately moulding a transparent sheet and their cavities are closed by respective zones of thin, easily-ruptured metal foil strips. The zones of the foil strips lying respectively behind the blisters are framed by the windows 13 of the panel 2.

In similar manner, the second blister packaging sheet 21, which is identical to the sheet 16, lies between the panel 5 and the rearwardly-folded panel 6 and has a rectangular array of blisters 22 protruding respectively through the windows 15 of the panel 5.

The package shown in FIGS. 1 to 4 is assembled by a pharmacist as follows. He is supplied with the card 1 which is printed on one side only, as is shown diagramatically in FIG. 1. The unprinted side of the card is covered with a thin film of a heat-sealable material. The two outer panels 2 and 6 of the card each have tacked to their unprinted surfaces respectively rectangular, easily-rupturable metal foils. Zones of each foil are respectively framed in the windows 13 and 15.

The exposed surfaces of the foils, that is to say, the surfaces visible when looking at the unprinted side of the card, are also provided with films of heat-sealable material which may cover the whole surface of the foil or only those portions which are actually to be in contact with the two blister sheets. The pharmacist is also provided with two identical, flat blister sheets 16 and 21 each preformed with a set of rectangular blisters corresponding in position and shape to the windows 13 and 15 of the inner panels 3 and 5 of the card 1.

The pharmacist is provided with a horizontal platen (not shown) provided with an array of recesses corresponding to the positions of the windows 13 and 15 and with means for locating the sides and ends of the card when placed, printed side down, onto the platen. The foils on the two end-panels of the card are then uppermost. The blister sheets 16 are placed on the respective panels 3 and 5 so that their blisters protrude downwards through the windows 13 and 15 of the panels and into the recesses of the platen beneath the card.

The pharmacist next loads the cavities of the blisters with the prescribed medication tablets. The two outer panels 12 and 14 are then folded over the backs of the associated panels 3 and 5 so that their foils engage the upper faces of the blister sheets. A flat platen (not shown) is placed on top of the panels 2 and 6 and pressed down and heated to fuse the heat-sealable material on the panels 2, 3, 5 and 6 and the foils, so that the assemblage of layers formed by the foil, blister sheet and the two panels becomes a unitary structure with the panels of each pair sandwiching a blister sheet and associated foil between them.

The spacing between the fold lines 8 and 9 defining the narrow, rectangular, center panel 4 of the card is substantially equal to the height of the blisters. The shape and locations of the blisters allows those of the sheet 21 to fit snugly between and beneath those of the sheet 16 when the two parts of the card are folded together as shown in FIG. 3. The resultant shallow, parallelepiped package is stiff and resistant to compression because of the close spacing of the blisters which are contiguous with one another and virtually lie in a single plane. A sheath holder 29, similar in shape to the slide holder of a matchbox, is provided to protect from damage the zones of the foil exposed in the windows 13 and 15.

As is apparent from FIG. 1, the printing on the card identifies the four columns of blisters with different times of day respectively, and the seven rows of blisters with different days of the week. Coloured banding identifies the four blisters corresponding to the different times of each day at which medication is to be taken. The coloured banding is kinked over the panel 4 of the card so that the eye of the patient can easily identify the blisters associated with a particular day. The vertical rectangular area to the right of the panel 5 as shown in FIG. 2, and the horizontal rectangular panel at the base of the panel, enable information such as the nature of the medication in the blisters and the name of the patient to be identified on the package.

OPERATION OF FIRST EMBODIMENT

To use the package described, the patient slides the folded card from the holder 29 and opens it to display the blisters as shown in FIG. 2. He can see immediately from the absence or presence of tablets in the blisters and the writing on the card at the ends of the blister lines, whether he has missed taking a medication at a prescribed time (which is indicated at the top of the columns,) or whether one is due. To take a medication, the patient simply applies thumb pressure to the front of the appropriate blister 17 to force its tablets out through the associated zone of the foil backing at the back.

DESCRIPTION OF SECOND EMBODIMENT

Figure 4:
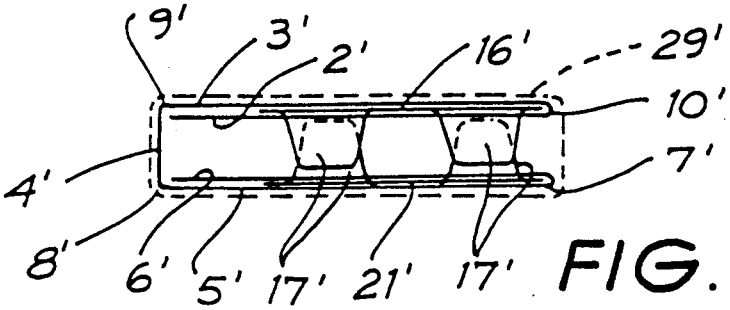
FIG. 4 is a view corresponding to FIG. 3 but showing a second embodiment of card with a different form of holder; and, FIG. 5 shows a partially folded card of a third embodiment of the invention.

In the embodiment of FIG. 4, parts corresponding to those of FIG. 3 and already described, are similarly referenced, and the reference numbers are primed to avoid them having to be described again. By a visual comparison of FIGS. 3 and 4 it will be seen that the main difference between the two embodiments is that the card panels 2' and 6' of FIG. 4 are folded forwardly over one another, rather than rearwardly as shown in FIG. 3. The embodiment of FIG. 3 offers certain advantages, as compared with that of FIG. 4, in printing and loading the card. In the embodiment of FIG. 4, the holder 29' comprises an open, sprung channel of transparent plastics, rather than a box-shaped metal sheath, and it is large enough to cover and protect the zones of foil exposed in the windows of the panels.

DESCRIPTION OF THIRD EMBODIMENT

Figure 5:
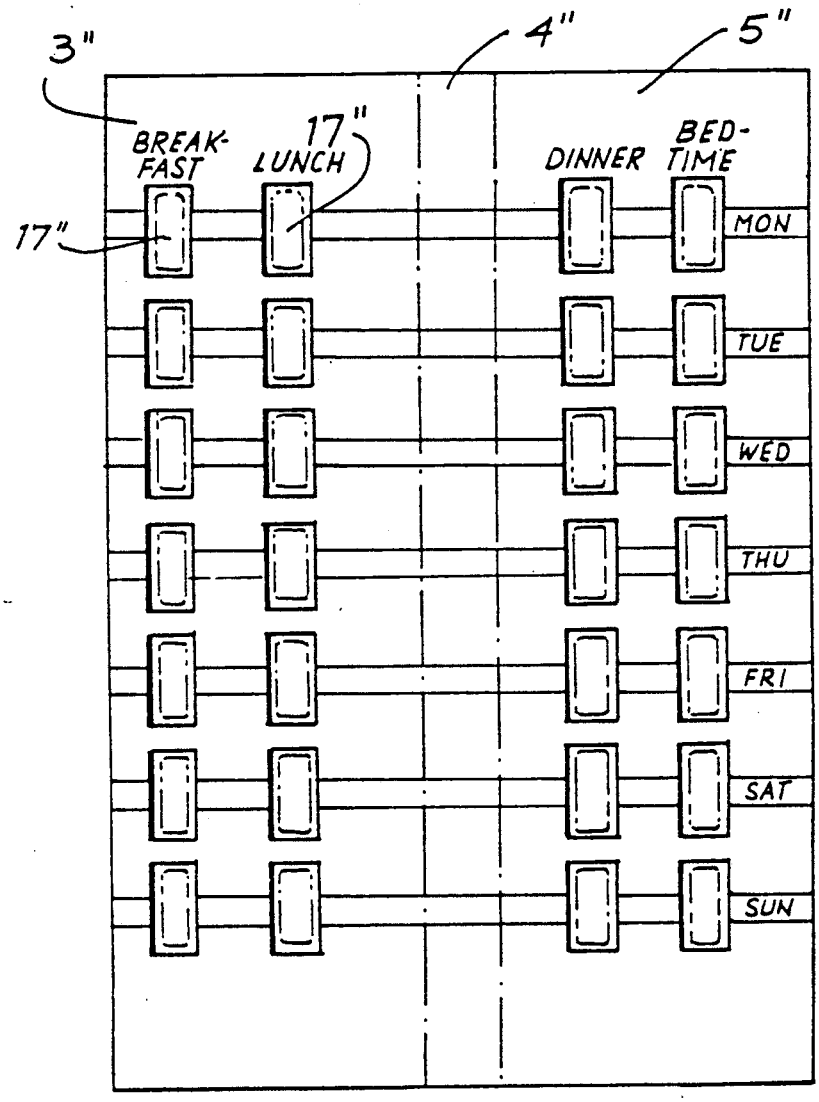

In FIG. 5, corresponding parts to those already described with reference to earlier embodiments are similarly referenced but the references are double primed. They will not therefore be again described. In the embodiment of FIG. 5 the blisters 17'' on the card panels 3'' and 5'' are turned through 90 degrees with respect to those shown in the earlier-described embodiments. Although a longer and slimmer package results, the blisters to be opened each day now lie in a straight horizontal row, rather than a kinked one, and the four blisters of each row are so spaced from one another that they interfit snugly when the two panels 3'' and 5'' of the card illustrated, are folded towards one another.

MODIFICATION

In a variation of the embodiments described, the holder 29 is made of transparent material and markings are provided on it to enable the patient to see through the holder whether he has taken his medication at a prescribed time, without actually having to remove the folded card from the holder 29.

We claim:

1. A disposable medication dispensing package comprising:

a pre-printed, thin, stiffly-flexible, paperboard card blank, fold lines being formed in said blank and dividing it into rectangular panels, said panels including two pairs of adjacent panels which are each formed with an array of apertures and which are folded over one another along a fold line to bring the apertures of the two panels of the pair into registration with one another;

a plurality of blister sheet and foil combinations each comprising a rectangular blister packaging sheet having a planar first face and a pattern of manually-depressible packaging blisters projecting from a second face of the sheet, and a rupturable metal foil adhering to said first face of the blister packaging sheet and providing a backing that occludes said blisters, one blister sheet and foil combination being sandwiched between the two panels of each pair of panels with the blisters protruding through the apertures of one panel of the pair and the metal foil backing exposed through the apertures of the other panel of the pair;

medication tablets of capsules held in place in said blisters by said foil; and means sealing areas of the panels of each pair to the confronting surfaces of the blister sheet and foil combination sandwiched between them, the preprinting on the blank associating each blister in the assembled package with a particular time and day of the week in which the medication in the blister is to be taken, and the stiffness of the blister sheet and foil combination being sufficiently enhanced by the two card panels sealed thereto to withstand buckling of the package when the blisters are manually depressed to eject their contents.

2. A package as claimed in claim 1, in which the blank includes two pairs of panels separated by an elongated rectangular hinge portion such that the package has an open condition in which the two pairs of panels lie substantially in a common plane and a folded condition in which the two pairs of panels confront each other and lie in planes that are spaced and substantially parallel, so that all the blisters lie in substantially the same plane when the package is in the open condition, and the two arrays of apertures are such that the blisters are able to interdigitate and all lie substantially in the same plane when the package is in its folded condition.

3. A medication dispensing package comprising:

a thin, flexible card formed with fold lines dividing said card into two pairs of panels, said panels being apertured to provide windows and the panels of each pair being folded together;

two thin, flexible blister sheets each having blisters protruding from one side and each located between a respective pair of folded-together panels with its blisters protruding through windows of one of the panels of the pair;

a continuous easily-ruptured foil covering the back of each blister sheet and exposed through the windows of the other panel of the pair of folded-together panels; and adhesive material bonding each blister sheet to the panel through whose windows its blisters protrude, and bonding each foil to the blister sheet whole back it covers and to the panel through whose windows it is exposed, the blisters that protrude from one of said pair of folded-together panels being staggered with respect to the blisters that protrude from the other pair of panels when the two pairs of panels are folded together.

4. A medication dispensing package comprising:

a thin, flexible card formed with fold lines dividing said card into two pairs of panels, said panels being apertured to provide windows and the panels of each pair being folded together;

two thin, flexible blister sheets each having blisters protruding from one side and each located between a respective pair of folded-together panels with its blisters protruding through windows of one of the panels of the pair;

a continuous easily-ruptured foil covering the back of each blister sheet and exposed through the windows of the other panel of the pair of folded-together panels; and adhesive material bonding each foil to the blister sheet whose back it covers and to the panel through whose windows it is exposed, and bonding each blister sheet to the panel through whose windows its blisters protrude, the blisters that protrude from on e of said pair of folded-together panels being staggered with respect to the blisters that protrude from the other pair of panels when the two pairs of panels are folded together, and there being printing on said card associating the rows of blisters on the card with different days of the week, and the columns of blisters on the card with different times of the day.

5. A package as claimed in claim 4, in which the fold lines are parallel.

6. A package as claimed in claim 5, in which the card is divided by the fold lines into five panels in which four are apertured and the fifth has a width substantially equal to the thickness of a common plane in which the blisters lie when the card is folded into a parallelepiped shape.

7. A package as claimed in claim 4, including a holder retaining the package in its folded condition and covering zones of the foils exposed in the windows when the package is not in use.

8. A package as claimed in claim 7, in which the holder is transparent.

9. A package as claimed in claim 8, in which the holder is a channel-shaped resilient element.

10. A package as claimed in claim 4, in which the card is rectangular, the blisters of two blister sheets respectively pass through the windows of two intermediate panels of the card, and the panels at the two ends of the card are respectively folded behind the two blister sheets.

11. A package as claimed in claim 4, wherein the two pairs of panels are first, second, third and fourth panels, with the second panel being between the first and third panels and the third panel between the second and fourth panels, and wherein one of the blister sheets has its blisters protruding through the windows of the second panel and the other blister sheet has its blisters protruding through the windows of the third panel.

* * * * *